US010611442B2

(12) United States Patent
Rasmussen et al.

(10) Patent No.: US 10,611,442 B2
(45) Date of Patent: Apr. 7, 2020

(54) INFLATABLE WATER-SPORTS BOARD

(71) Applicant: Starboard Co. Ltd., Samutprakarn (TH)

(72) Inventors: Svein Rasmussen, Samutprakarn (TH); Albert Pijuan Monne, Barcelona (ES); Nimit Promjan, Samutprakarn (TH)

(73) Assignee: Starboard Co. Ltd, Samutprakarn (TH)

( * ) Notice: Subject to any disclaimer, the term of this patent is extended or adjusted under 35 U.S.C. 154(b) by 0 days.

(21) Appl. No.: 15/923,160

(22) Filed: Mar. 16, 2018

(65) Prior Publication Data

US 2018/0273147 A1 Sep. 27, 2018

(30) Foreign Application Priority Data

Mar. 21, 2017 (AU) ..... 2017900990

(51) Int. Cl.
*B63B 35/79* (2006.01)
*B63B 7/08* (2020.01)

(52) U.S. Cl.
CPC ..... *B63B 35/7913* (2013.01); *B63B 7/085* (2013.01)

(58) Field of Classification Search
CPC . B63B 35/79; B63B 35/7906; B63B 35/7913; B63B 7/085
See application file for complete search history.

(56) References Cited

U.S. PATENT DOCUMENTS

| | | | | |
|---|---|---|---|---|
| 3,657,753 | A | 4/1972 | Le Blanc, Sr. | |
| 9,394,037 | B1 * | 7/2016 | Schitzhofer | B63B 35/85 |
| 10,086,918 | B2 * | 10/2018 | Pepper | B63B 7/08 |
| 2009/0049757 | A1 | 2/2009 | Potter | |
| 2011/0207376 | A1 | 8/2011 | Lindstrom | |

FOREIGN PATENT DOCUMENTS

| | | | | |
|---|---|---|---|---|
| WO | 2008049158 | A1 | 5/2008 | |
| WO | 2017008916 | A1 | 1/2017 | |
| WO | WO-2017144839 | A1 * | 8/2017 | B63B 35/7913 |

OTHER PUBLICATIONS https://www.the-house.com/learn/best-inflatable-stand-up-paddle-boards-2016// dated Apr. 26, 2016; retrieved from the internet on Sep. 4, 2019. (Year: 2016).*

Australian Patent Office International Search Report for co-pending AU2017900990, 8 pages, dated Dec. 4, 2017.

* cited by examiner

*Primary Examiner* — Anthony D Wiest
(74) *Attorney, Agent, or Firm* — Kagan Binder, PLLC

(57) ABSTRACT

An inflatable board for water sports such as surfing, wind-surfing and kite surfing uses at least one cord for stiffening. The cord is arranged to be placed in tension upon inflation of the board, and acts to brace the board in use.

4 Claims, 7 Drawing Sheets

INFLATABLE WATER-SPORTS BOARD

CROSS-REFERENCE TO RELATED APPLICATIONS

This application claims priority to Australia Patent Application No. 2017900990, filed on Mar. 21, 2017 which is incorporated by reference herein in its entirety

FIELD OF THE INVENTION

The present invention relates to inflatable water-sports boards such as surfboards, windsurfing boards, kitesurfing boards and the like.

BACKGROUND TO THE INVENTION

It is known to create water craft and water-sports boards from inflatable materials. Often, such boards are created with rigid noses and tail pieces for protection, with the body of the board being formed from an inflatable element such as coated 'drop stitch' fabric. In this way, the board can be deflated for easy transport, and inflated for use.

The use of such water-sports boards is limited by an inherent lack of rigidity. Due to the flexibility required for inflation, the material from which the board is formed must have significantly less stiffness than boards formed from rigid materials such as fibreglass.

The present invention seeks to provide an inflatable board with enhanced stiffness characteristics.

SUMMARY OF THE INVENTION

According to one aspect of the present invention there is provided an inflatable board, the board including a first connection point; a second connection point, and a flexible cable element passing between the first connection point and the second connection point, whereby the cable is arranged to be in tension when the board is inflated, thereby providing stiffness to the board.

It will be understood that 'cable' is used herein as an inclusive term encompassing ropes, wires, leads, cords threads and the like.

It is anticipated that the board will be a water-sports board.

There may be a plurality of cables passing between respective first and second connection points.

The cable(s) may be internal to the inflatable board. Alternatively, the cable(s) may be external.

At least one cable may be arranged to pass around a nosepiece and/or a tailpiece of the board. It is anticipated that the cable will run along an underside of the board, with at least one of the first and second connection points being located on a top surface of the board.

The first and second connection points may be single cable coupling positions. Alternatively, at least one of the first and second connection points may comprise a number of alternative cable coupling positions.

At least one of the first and second connection points may include a cable tensioning means. In an alternative embodiment, the cable may include a cable tensioning means located along its length.

It is anticipated that the cable may have some degree of elasticity.

According to a second aspect of the present invention there is provided a method of stiffening an inflatable board, the method including the steps of providing a cable between two connection points on the board, and inflating the board in order to bring the cable into tension.

BRIEF DESCRIPTION OF THE DRAWINGS

It will be convenient to further describe the invention with reference to preferred embodiments of the present invention. Other embodiments are possible, and consequently the particularity of the following discussion is not to be understood as superseding the generality of the preceding description of the invention. In the drawings.

DETAILED DESCRIPTION OF PREFERRED EMBODIMENTS

Referring to the Figures, there is shown in FIGS. 1 to 6 a water-sports board 10 having an upper side 12 and an underside 14.

Figure 1:
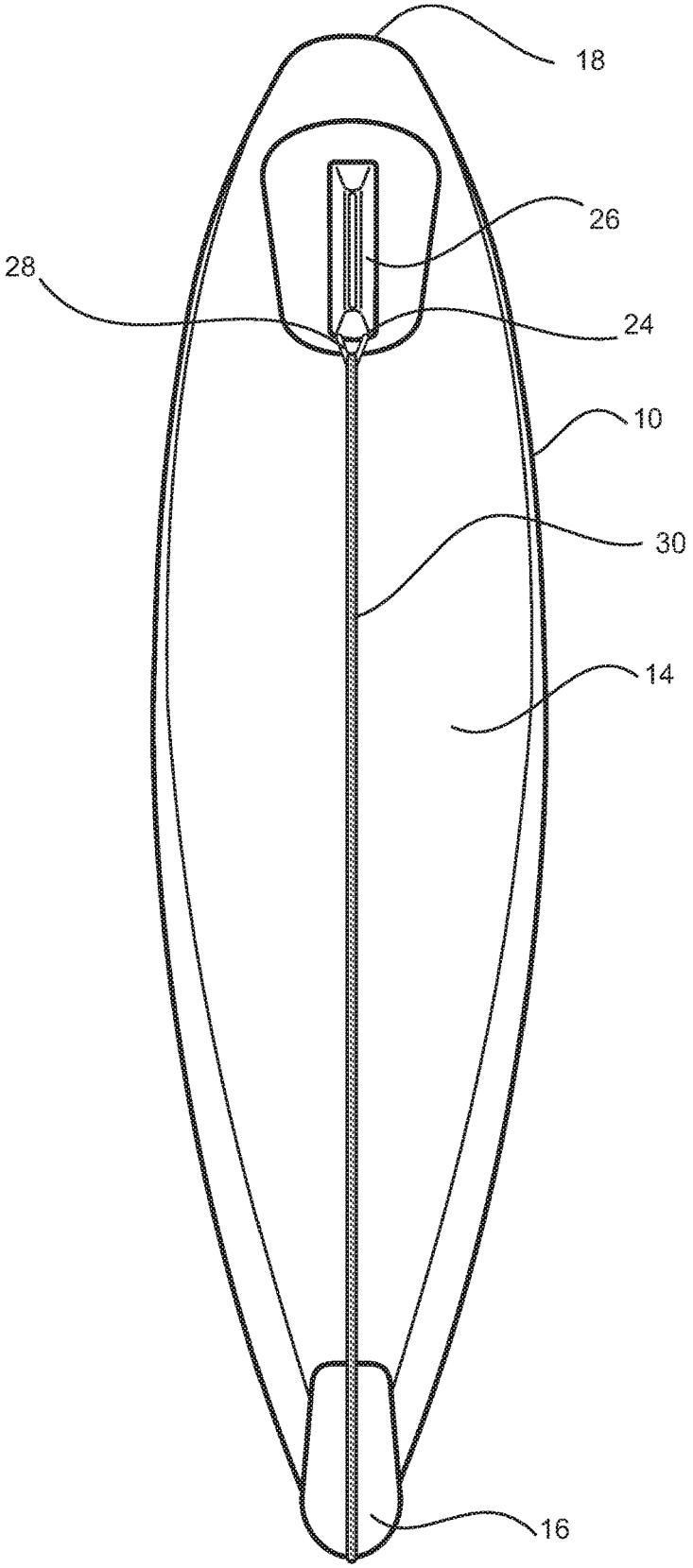
FIG. 1 is an underside view of a water-sports board in accordance with the present invention.
Figure 2:
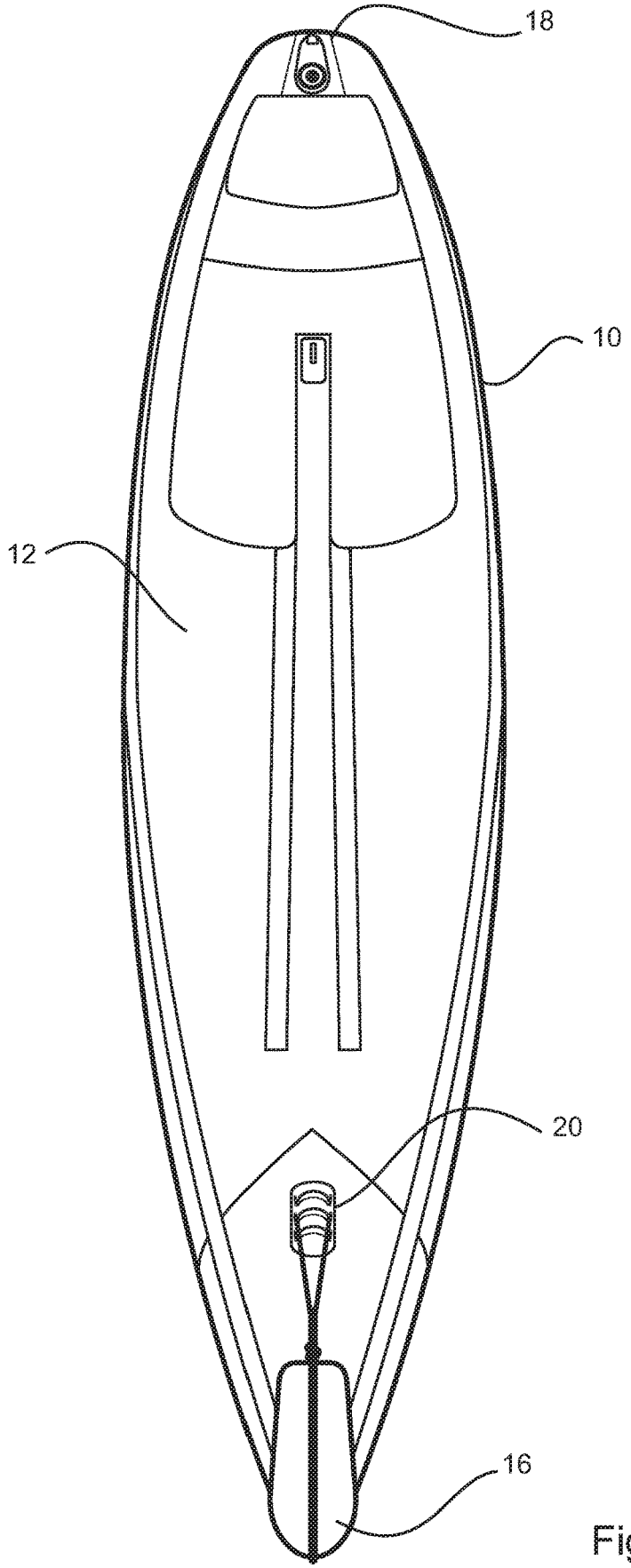
FIG. 2 is a top view of the front of the water-sports board of FIG. 1.
Figure 3:
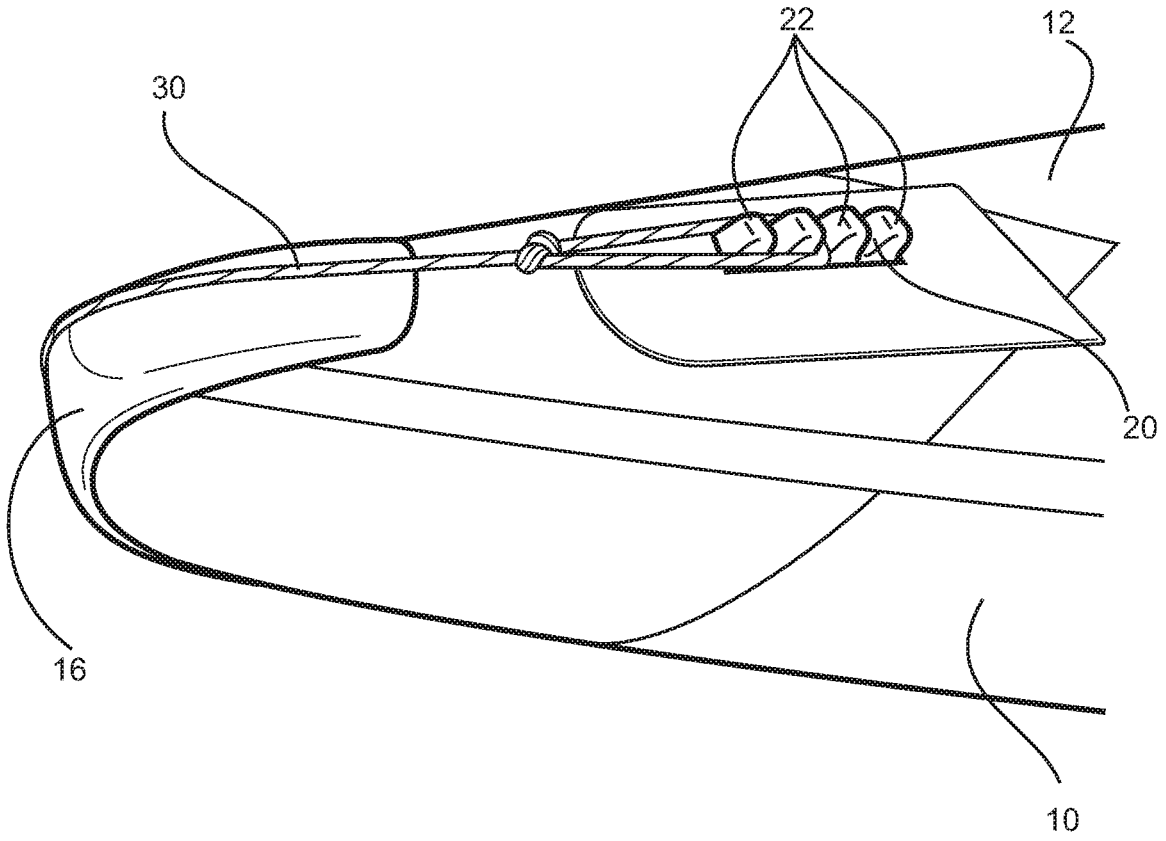
FIG. 3 is a perspective of the front end of the water-sports board of FIG. 1.
Figure 6:
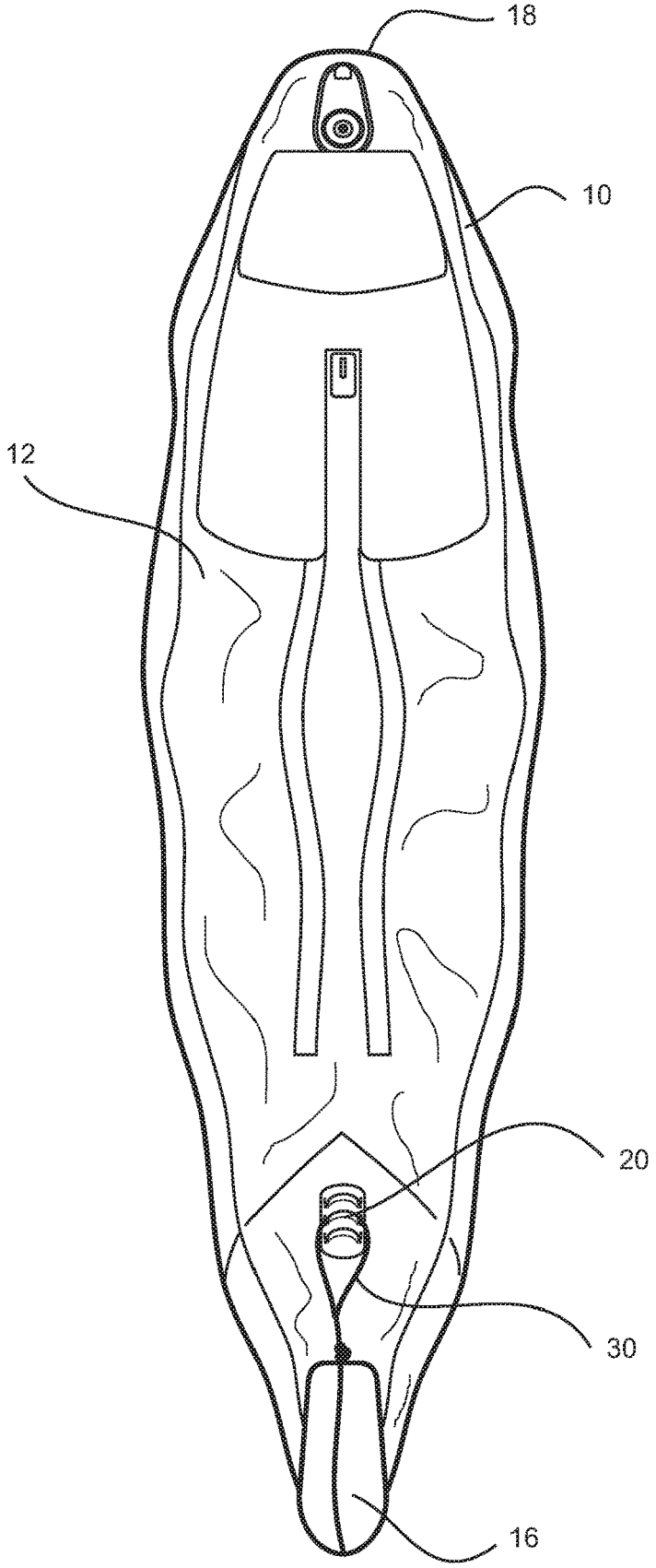
FIG. 6 is a top view of the water-sports board of FIG. 1, prior to inflation.
Figure 7:
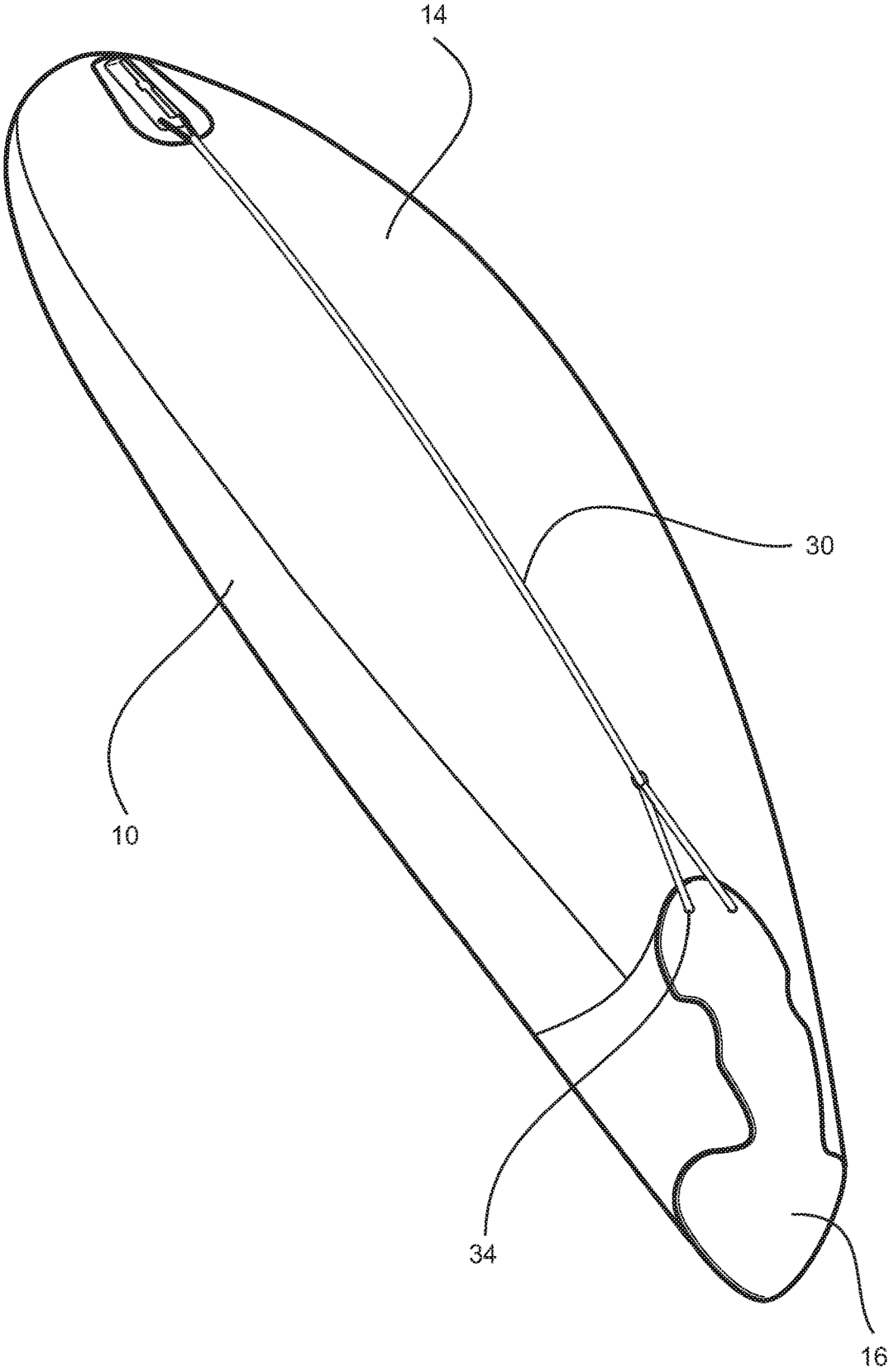
FIG. 7 is an underside view of an alternative water-sports board in accordance with the present invention; viewed from the front.
Figure 8:
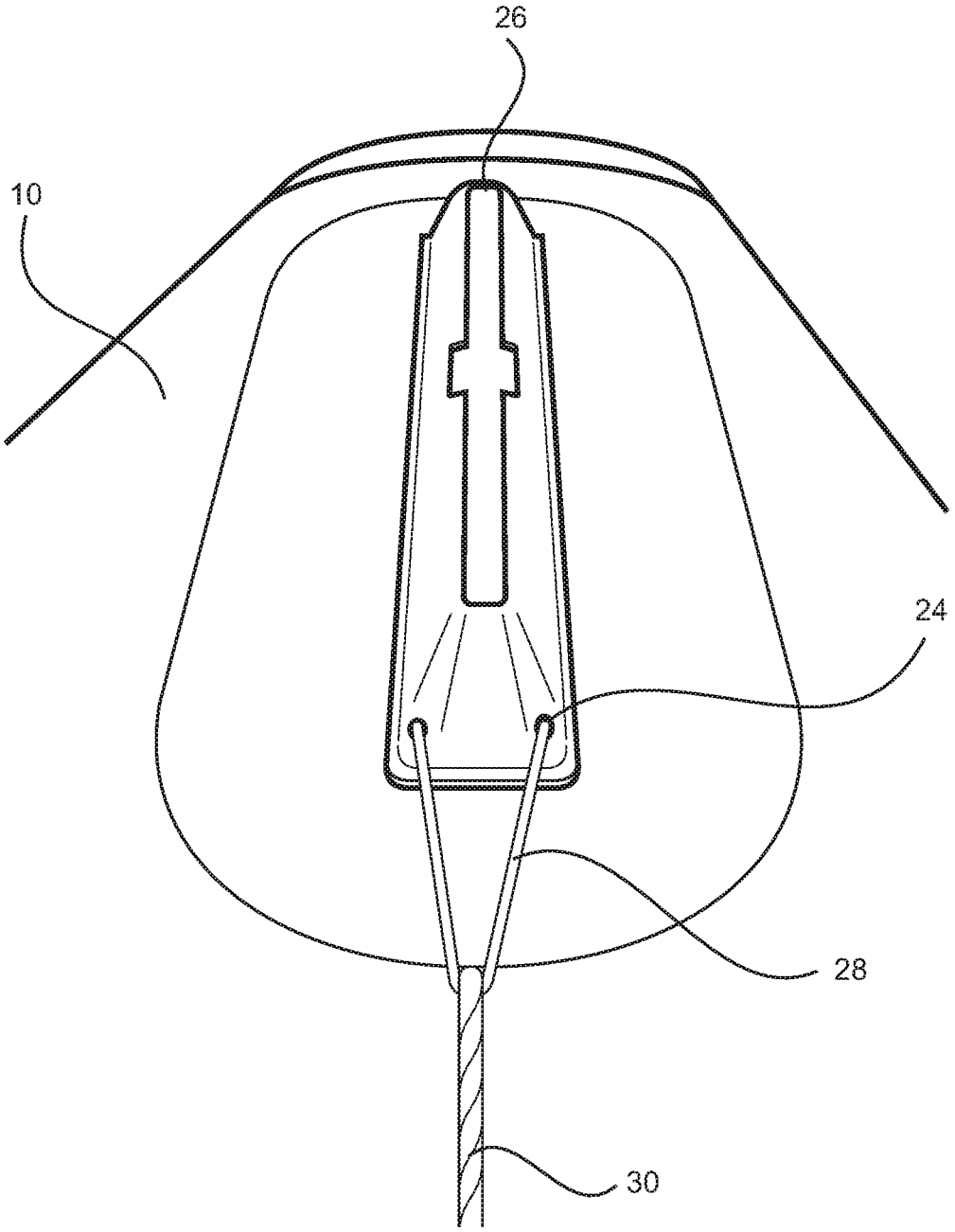
FIG. 8 is an underside view of the rear of the water-sports board of FIG. 4.

The board 10 has a relatively rigid nose piece 16 and a relatively rigid tail piece 18. Otherwise, the board 10 has a body formed of a flexible, inflatable material. It will be appreciated that FIGS. 1-3 show the body in an inflated condition. FIGS. 6 to 8 show the board 10 in an uninflated condition, in which it can be rolled-up for ease of transport.

The board 10 has a first connection portion 20 located on the upper side 12, near the nose piece 16. The first connection portion 20 includes a plurality of hooks 22 which are spaced in a longitudinal direction along the board 10.

The board 10 has a second connection portion 24 located on the lower side 12, near the tail piece 18. The second connection portion 24 in this embodiment is located at a fin plug 26. The connection portion 24 includes holes within the fin plug 26 into which a lead 28 can be tied.

A cable 30 extends along the underside 14 of the board 10, from the second connection portion 24 to the nose piece 16, then about the nose piece 16 to the first connection portion 20.

The cable 30 is mounted to the second connection portion 24 by the expedient of tying a lead 28 to the second connection portion 24, and then by looping the cable 30 through the lead 28.

It will be appreciated that the length of the lead 28 can be adjusted in order to increase tension on the cable 30.

The cable 30 is mounted to the first connection portion 20 by looping an end of the cable 30 around one of the hooks 22.

It will be appreciated that the mounting of the cable 30 to the first and second connection portions 20, 24 is a relatively trivial exercise when the board 10 is deflated as shown in FIG. 6.

When the board 10 is inflated, the internal pressure causes expansion of the body of the board 10. This expansion acts to place the cable 30 into tension. The more the board 10 is inflated, the more tension is applied to the cable 30.

Additional tension can be applied by shortening of the lead 28. It is also envisaged that the cable 30 may include a tensioning mechanism located along its length.

The tensioned cable 30 provides significant additional stiffness the board 10. It will be appreciated that most of the cable 30 passes along the underside of the board 10, and thus does not interfere with a rider of the board 10.

Figure 4:
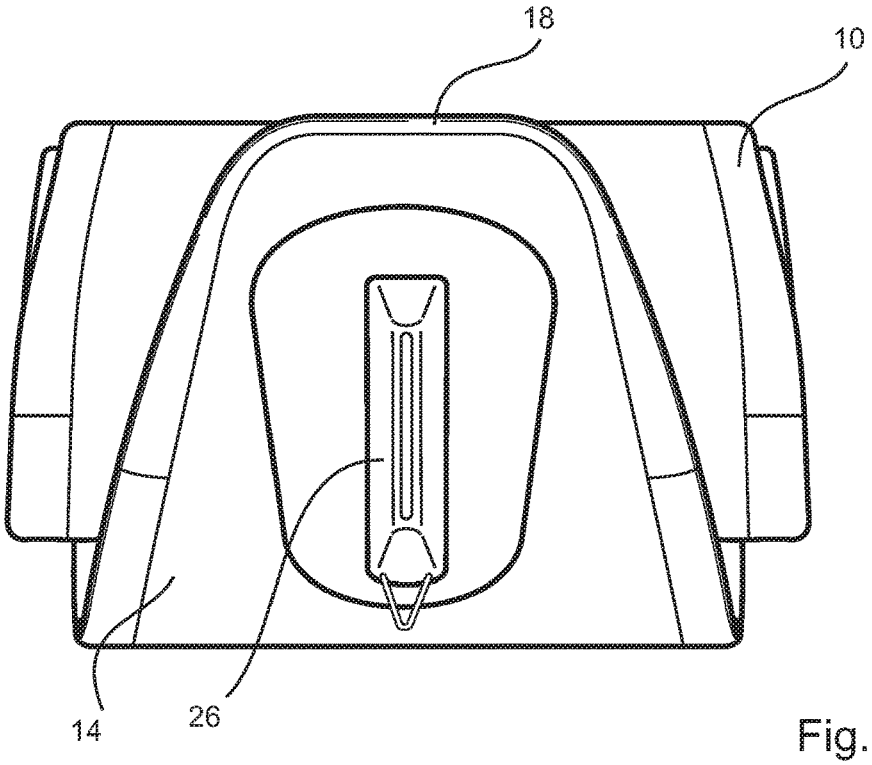
FIG. 4 is a front view of the water-sports board of FIG. 1, in a fully collapsed state.
Figure 5:
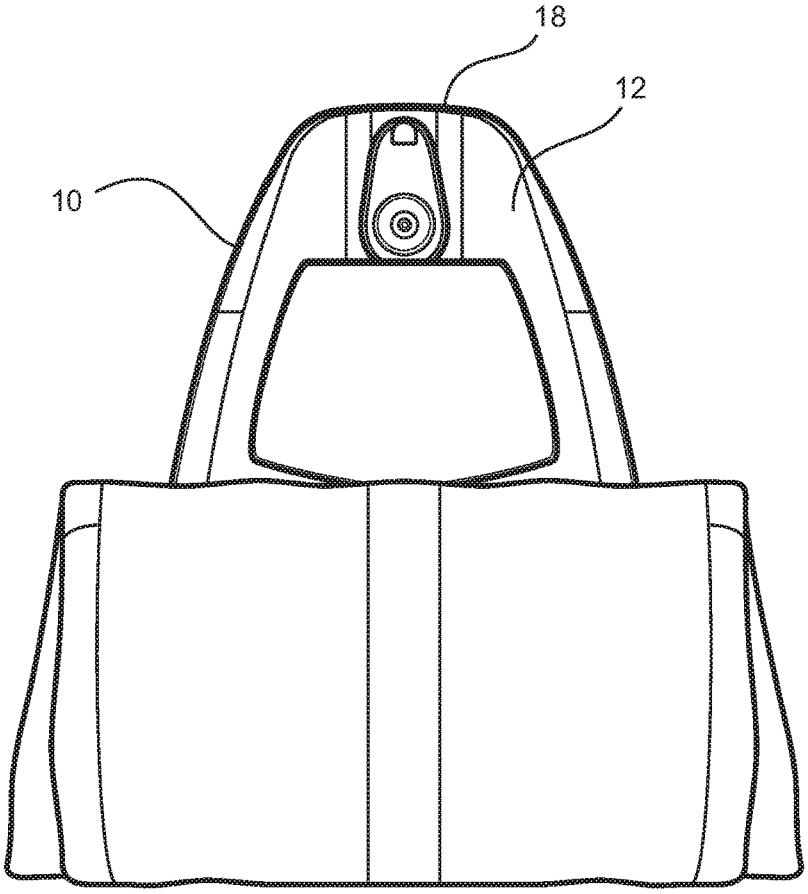
FIG. 5 is a front view of the water-sports board of FIG. 1, in a partially unrolled state.

FIGS. 4 and 5 show a second embodiment of the present invention, with a first connection portion 34 formed by holes in the underside of the nosepiece 16. In this embodiment the entirety of the cable 30 is located on the underside 14 of the board 10.

Modifications and variations as would be apparent to a skilled addressee are deemed to be within the scope of the present invention. These include the use of multiple cables about the board 10, and the use of cables located internally of the body of the board 10.

The invention claimed is:

1. An inflatable board, the board including a first connection point; a second connection point, and a flexible cable element passing between the first connection point and the second connection point, whereby the cable is arranged to be in tension when the board is inflated, thereby providing stiffness to the board, at least one cable being external to the inflatable board and being arranged to pass around a nosepiece and/or a tailpiece of the board;

wherein the cable runs along an underside of the board, with at least one of the first and second connection points being located on a top surface of the board.

2. An inflatable board as claimed in claim 1, wherein the first and second connection points are single cable coupling positions.

3. An inflatable board as claimed in claim 1, wherein at least one of the first and second connection points comprises a plurality of alternative cable coupling positions.

4. An inflatable board as claimed in claim 1, wherein at least one of the first and second connection points may include a cable tensioning means.

* * * * *